US010257902B2

(12) United States Patent
Trouwborst et al.

(10) Patent No.: US 10,257,902 B2
(45) Date of Patent: Apr. 9, 2019

(54) SLEEPY LIGHT

(71) Applicant: SIGNIFY HOLDING B.V., Eindhoven (NL)

(72) Inventors: Marius Leendert Trouwborst, Den Bosch (NL); Berent Willem Meerbeek, Veldhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/751,599

(22) PCT Filed: Aug. 11, 2016

(86) PCT No.: PCT/EP2016/069179
§ 371 (c)(1),
(2) Date: Feb. 9, 2018

(87) PCT Pub. No.: WO2017/025613
PCT Pub. Date: Feb. 16, 2017

(65) Prior Publication Data

US 2018/0235041 A1 Aug. 16, 2018

(30) Foreign Application Priority Data

Aug. 13, 2015 (EP) ..... 15180849

(51) Int. Cl.
*H05B 33/08* (2006.01)

(52) U.S. Cl.
CPC ..... *H05B 33/086* (2013.01); *H05B 33/0845* (2013.01); *H05B 33/0869* (2013.01)

(58) Field of Classification Search
CPC ..... H05B 33/086; H05B 33/0845; H05B 33/0869; H05B 33/0857; A61M 2021/0044
See application file for complete search history.

(56) References Cited

U.S. PATENT DOCUMENTS 8,963,450 B2 2/2015 Maxik et al.
2014/0184088 A1* 7/2014 Lu ..... H05B 33/0863 315/210
2014/0228914 A1 8/2014 Van De Ven et al.
2014/0362557 A1 12/2014 Ulasyuk et al.
(Continued)

FOREIGN PATENT DOCUMENTS

EP 2094064 A1 8/2009
WO 0220079 A1 3/2002
(Continued)

*Primary Examiner* — Dedei K Hammond
*Assistant Examiner* — Raymond R Chai
(74) *Attorney, Agent, or Firm* — Akarsh P. Belagodu

(57) ABSTRACT

The invention provides a lighting device (100) comprising a first light source (10) and a second light source (20), a control system (50) configured to control the first light source (10) and the second light source (20), wherein the first light source (10) is configured to provide first light source light (11) having a correlated color temperature (CCT) of at maximum 3000 K and a color rendering index (CRI) of at least 75, and wherein the second light source (20) is configured to provide second light source light (21) having a dominant wavelength selected from the range of (575-780) nm and having a color rendering index of at maximum (70).

15 Claims, 1 Drawing Sheet

(56) References Cited

U.S. PATENT DOCUMENTS

| | | | | |
|---|---|---|---|---|
| 2015/0055335 | A1 | 2/2015 | Ho et al. | |
| 2015/0062892 | A1* | 3/2015 | Krames | H05B 37/0281 362/231 |
| 2015/0327342 | A1* | 11/2015 | Lu | H05B 33/0863 315/294 |

FOREIGN PATENT DOCUMENTS

| | | | |
|---|---|---|---|
| WO | 2008137839 | A1 | 11/2008 |
| WO | 2013140296 | A1 | 9/2013 |
| WO | 2014117466 | A1 | 8/2014 |
| WO | 2014165692 | A1 | 10/2014 |
| WO | 2015052207 | A1 | 4/2015 |

* cited by examiner

SLEEPY LIGHT

CROSS-REFERENCE TO PRIOR APPLICATIONS

This application is the U.S. National Phase application under 35 U.S.C. § 371 of International Application No. PCT/EP2016/069179, filed on Aug. 11, 2016, which claims the benefit of European Patent Application No. 15180849.0, filed on Aug. 13, 2015. These applications are hereby incorporated by reference herein.

FIELD OF THE INVENTION

The invention relates to a lighting device and a lighting system comprising such lighting device.

BACKGROUND OF THE INVENTION

Lighting devices having switchable lighting properties are known in the art. US2015/0055335, for instance, describes a day/night switchable light adjusting device and a light adjusting method. The day/night switchable light adjusting device is composed of a plurality of panels; each panel includes a reflecting surface and at least one lighting unit. Each lighting unit can emit various wavelength region lights, and the various wavelength lights are mixed on a light collecting component. A control unit is provided for adjusting the various wavelength region lights corresponding to day/night variation. A light intensity of a cyan region light or a blue region light is reduced for preventing an over-inhibition on a quantity of Melatonin.

SUMMARY OF THE INVENTION

Critical to our sleep/wake cycle is melatonin, a hormone that promotes sleep during night time. During day time, natural daylight with high correlated color temperature (CCT; herein also indicated as "color temperature") and intensity suppresses melatonin production in the body and as a result energizes people, making them more awake and alert. At the beginning and end of the day the spectrum is shifted towards lower CCT and intensity levels, causing melatonin secretion.

Over about 60% of adults get fewer hours of sleep than what they think they need. Further, close to three in ten parents (29%) report experiencing insomnia (sleeplessness) at least a few nights a week. The production of melatonin is directly impacted by light, both natural light and artificial light. Bright evening light can suppress melatonin production and delay sleep and make it more difficult to wake up in the morning. In particular the last two hours before bedtime it appears beneficial to use only light that is dim and low in blue content.

Many people use artificial lighting in the hours before going to sleep, for example for reading. But exposure to light in the evening, in particular to blue light, can suppress melatonin production and prevent sleepiness. On the other hand, reading in dim or red light is also not desirable for visual comfort and color rendering.

Hence, it is an aspect of the invention to provide an alternative lighting device, which preferably further at least partly obviates one or more of above-described drawbacks and/or which can cope with above-indicated issues. Amongst others, it is an aim of this invention to provide optimal light spectrum that maximizes visual quality of the lighting while minimizing the melatonin suppression. State-of-the art solutions use blue filters to create non-biologically activating light. However, such solution provides one particular light spectrum and/or leads to unnecessary elimination of light (and thus efficiency reduction).

An element of the invention is a lighting device (or luminaire) that has at least two light sources, especially with relatively low blue content (e.g. especially Melanopsin Effectiveness factor (MEF) below about 0.35 (see also below)), allowing at least two modes of lighting, while the color rendering index (CRI) of the two modes differ by e.g. at least about 20 points (or "units"). This allows selecting the optimum light condition for a certain activity while supporting sleep. Especially, the two light sources can be controlled independently in various ways, either manually through user input (e.g. buttons, rotary), automatically (e.g. time-based, ambient light levels, detected activity), or through a connected device (sensor, smart appliance, smartphone, etc.).

Hence, in a first aspect the invention provides a lighting device comprising a first light source and a second light source, a control system configured to control the first light source and the second light source, wherein (i) the first light source is configured to provide first light source light, especially having a correlated color temperature (CCT) of at maximum 3000 K, and especially having a color rendering index (CRI) of at least 75, and wherein (ii) the second light source is configured to provide second light source light, especially having a dominant wavelength selected from the range of 575-780 nm, and especially having a dominant wavelength selected from the range of 575-675 nm, and especially having a color rendering index of at maximum 70.

This lighting device may be used for a plurality of purposes. In particular during the hours before sleeping time and during night time awakenings, users can benefit from the at least two light settings as they both have a low impact on the natural process of melatonin suppression and will support a natural day/night rhythm and sleep routine. However, at least one setting may have a light with a relatively high color rendering (CRI) which is relevant for example for (relatively) high visual comfort, e.g. for use during bedtime reading. For activities that have no high color rendering requirements a light setting with even lower impact on the melatonin production can be selected. For instance, for finding a way in house or in a hospitality area, or for use during a diaper change, etc., during the night, high color rendering light is not necessary.

As indicated above, the lighting device comprises at least two light sources. These light sources are configured to provide the indicated light. Note however, that the terms "first light source" and "second light source" each independently may include a plurality of light sources. These terms may each independently also refer to a plurality of different light sources. However, the first source is especially configured to provide first light source light having a correlated color temperature (CCT) of at maximum 3000 K and a color rendering index (CRI) of at least 75 and the second light source is especially configured to provide second light source light having a dominant wavelength selected from the range of 575-780 nm, especially selected from the range of 575-675 nm, and in embodiments having a color rendering index of at maximum 70. Hence, when essentially only first light source light would be provided, this may comply with the above indicated first setting; when essentially only second light source light would be provided, this may comply with the above indicated second setting.

In a specific embodiment, the light source (i.e. the first light source and/or the second light source) comprises a solid state light source (such as a LED or laser diode). The term "light source" may also relate to a plurality of light sources, such as 2-512 (solid state) LED light sources. Hence, the term LED may also refer to a plurality of LEDs. Therefore, in embodiments the first light source comprises one or more solid state light sources, and/or the second light source comprises one or more solid state light sources.

The first light source is especially configured to provide white light, as can also be derived from the fact that the CRI of the first light source light is larger than 75 and that the light source light has a color temperature (of 3000 K or smaller). Especially, the color temperature is selected from the range of 1500-3000 K, such as in the range of 1700-2500 K The term white light herein, is known to the person skilled in the art. It especially relates to light within about 15 SDCM (standard deviation of color matching) from the BBL (black body locus), especially within about 10 SDCM from the BBL, even more especially within about 5 SDCM from the BBL. Hence, the first light source may e.g. a white light emitting LED with a relatively low color temperature. For instance, this may include a phosphor converter LED (pcLED).

The second light source is especially configured to provide second light source light with a relatively yellow-red appearance, somewhat like natural light at sunset. Hence, the second light source light is not necessarily white light, as can also be derived from the CRI of at maximum about 70 and the dominant wavelength of the second light source light in the range of 575-780 nm, especially selected from the range of 575-675 nm. In an embodiment, the dominant wavelength is selected from the range of 585-592 nm. Hence, the second light source may especially be configured to provide amber light. Therefore, in embodiments the second light source comprises at least a solid state light source configured to provide amber light. For instance, the second light source may comprise an amber LED.

As indicated above, the first light source may especially be useful for uses wherein a relative good color rendition is desired, such as reading, whereas the second light source may especially be applied for uses where a lower color rendition is necessary. Hence, if desired, the second light source may produce second light source light with an even lower blue content (see also below). In embodiments, the first light source and said second light source are configured to provide said first light source light and said second light source light, respectively, with CRI's differing at least 15 CRI units, even more especially the CRI's differ with at least 20 CRI units. For instance, the CRI of the first light source light may be especially at least 75; the CRI of the second light source light is equal to or smaller than 60 CRI units, such as in the range of 20-55.

The blue content of the first light source light and/or the second light source light may be relatively be small. Especially the spectral contribution in the range of 440-530 nm may be relatively be low, especially of the second light source light. Hence, in embodiments first light source and the second light source are configured to provide said first light source light and said second light source light, having a ratio of the total number of photons in the wavelength range of 440-530 nm to the total number of photons in the wavelength range of 380-780 nm of especially at maximum 0.2 and especially at maximum 0.01, respectively. These ratio's are herein also indicated as first ratio and second ratio, respectively.

Therefore, in embodiments first light source is configured to provide said first light source light, having a (first) ratio of the total number of photons in the wavelength range of 440-530 nm to the total number of photons in the wavelength range of 380-780 nm of at maximum 0.3, such as especially at maximum 0.2, such as in the range of 0.01-0.2. In further embodiments, the second light source is configured to provide said second light source light, having a (second) ratio of the total number of photons in the wavelength range of 440-530 nm to the total number of photons in the wavelength range of 380-780 nm of at maximum 0.05, such as at maximum 0.03, like especially at maximum 0.01 (such as 0-0.01).

Especially, the first ratio is larger than the second ratio. The second ratio can substantially be zero (in the absence of blue light). For instance, at 2000 K the first ratio may be in the range of 0.03-0.18. A pcAmber LED may have a (second) ratio of about 0.002.

Next to the commonly known cones and rods, the human eye has melanopsin containing photoreceptors, affecting melatonin secretion, which are sensitive in a specific wavelength range. The relative spectral sensitivity for photopic and melanopic receptors are provided in FIG. 1. If the spectral power in the melanopic wavelength range is absent or low, melatonin hormone production will be enabled to promote sleep. If the spectral power in the melanopic range is high enough, melatonin production will be suppressed and consequently we will become more alert. The effectiveness of suppressing melatonin production can be expressed in terms of the melanopsin effectiveness factor (MEF). This factor is calculated by multiplying the spectral power distribution of the light emitted by a lighting apparatus (SPD (λ)) with the melanopic sensitivity function (m(λ)) divided by the product of SPD(λ) and the photopic sensitivity (V(λ)), normalized by the areas of m(λ) and V(λ), see equation 1 (and see also FIG. 1).

$$\mathrm{MEF}=([\Sigma V(\lambda)]/[\Sigma \mathrm{m}(\lambda)])\cdot[\Sigma(\mathrm{SPD}(\lambda)\cdot m(\lambda))]/[\Sigma(\mathrm{SPD}(\lambda)\cdot V(\lambda))] \quad \text{(equation)}$$

This can be simplified to $$\mathrm{MEF}=1.22\cdot[\Sigma(\mathrm{SPD}(\lambda)\cdot m(\lambda))]/[\Sigma(\mathrm{SPD}(\lambda)\cdot V(\lambda))] \quad \text{(equation)}$$

as $$MEF = 1.22\cdot\frac{\sum_{\lambda=380\,nm}^{\lambda=780\,nm}(SPD(\lambda)\cdot m(\lambda))}{\sum_{\lambda=380\,nm}^{\lambda=780\,nm}(SPD(\lambda)\cdot V(\lambda))}$$

Hence, the above indicated summations are over the visible range of 380-780 nm.

Hence, especially good results may be obtained in embodiments wherein said first light source and said second light source are configured to provide said first light source light and said second light source light, respectively, each having a Melanopsin effectiveness factor (MEF) value of at maximum 0.4, wherein MEF is defined as $$MEF = 1.22\cdot\frac{\sum_{\lambda=380\,nm}^{\lambda=780\,nm}(SPD(\lambda)\cdot m(\lambda))}{\sum_{\lambda=380\,nm}^{\lambda=780\,nm}(SPD(\lambda)\cdot V(\lambda))}$$

wherein SPD(λ) defines the spectral power distribution of the light source light emitted by the respective light source, wherein m(λ) is the normalized melanopic sensitivity function (as (especially) defined in FIG. 1), wherein V(λ)) is the normalized photopic sensitivity function (as (especially) defined in FIG. 1), wherein said first light source light has a MEF value $MEF_1$ and wherein said second light source light has a MEF value $MEF_2$, wherein $MEF_2<MEF_1$. Even more especially, the first light source and the second light source are configured to provide said first light source light and said second light source light, respectively, having a difference in MEF of at least 0.05. For instance, in embodiments the first light source is configured to provide the first light source light having said $MEF_1$ value selected from the range of 0.2-0.4, and(/or) the second light source is configured to provide said second light source light having said $MEF_2$ value selected from the range of 0.02-0.15. With such values, both the light of the first light source and of the second light source may have a minimum impact on the melatonin production/suppression.

The first light source and the second light source are each controllable (by the control system). In an embodiment, the intensities are independently controllable to values between "on" and "off". In embodiments, the intensity of the light of the first light source and/or the light of the second light source may be controlled stepless. The control system is especially configured to control the first light source and the second light source, i.e. to control the intensity of the first light source light and the second light source light. In embodiments, the lighting device may be configured to provide the full range between only first light source light and only second light source light. Hence, the control system may be configured to control the power provided to the light sources.

The control system may be configured external from the lighting device. Optionally, the control system may comprise a plurality of elements, of which some may be comprised by the lighting device and others may be external from the lighting device (such as a remote user interface, see also below).

Optionally, also a source of power may be included in the lighting device, such as in the case of certain handheld flash lights.

The lighting device may e.g. be integrated in a lighting system with a plurality of lighting device and optional other type of lighting devices than described herein.

In yet a further specific embodiment, the control system is configured to control the power provided to the light source as function of an input signal of a user interface. This user interface may be integrated in the lighting device, but may also be remote from the lighting device. Hence, the user interface may in embodiments be integrated in the lighting device but may in other embodiments be separate from the lighting device. The user interface may e.g. be a graphical user interface. Further, the user interface may be provided by an App for a Smartphone or other type of mobile device.

Therefore, the invention also provides (in a further aspect) a computer program product, optionally implemented on a record carrier (storage medium), which when run on a computer executes the method as described herein (see below) and/or can control the lighting device as described herein (as function of the power provided to the light sources). Especially, the control system may be configured to control the first light source light and/or the second light source light as function of one or more of (i) an ambient light sensor signal, (ii) a motion sensor signal, (iii) a sound sensor signal, (iv) a timer signal, (v) a date signal, and (vi) a user interface signal. Hence, the lighting device may comprise a timer or may be functionally coupled with a timer. The timer may be used to provide one or more of the date and the time, i.e. a date signal and a timer signal, respectively. Alternatively or additionally, the lighting device may comprise a sensor or may be functionally coupled with a sensor. The term "sensor" may also refer to a plurality of (different) sensors. For instance, the timer may be used to switch off the first light source light and/or the second light source light after a predetermined time. Further, for instance the sensor may be a motion sensor, configured to sense motion, with the control system configured to switch on the first light source and/or the second light source when the motion sensor senses motion or presence of e.g. a person.

The first light source and the second light source may share a light exit window. Note that the term "light exit window" may also refer to a plurality of light exit windows. For instance, a first set of a first light source and a second light source may share a first light exit window and a second set of a(nother) first light source and a(nother) second light source may share a second light exit window, etc. However, also a plurality of first light sources and a plurality of second light source may share a single light exit window. The light exit window especially comprises a light transmissive material, such as a polymeric material, glass, quartz, a ceramic material, etc. The light exit window has a transmissivity for the light source light of the light sources, thereby allowing first light source light and/or second light source light to propagate through the light exit window and propagate further downstream from the light exit window, in a direction away from the lighting device. Here below, the lighting device is further described with reference to the light exit window being shared by the first light source and the second light source. However, optionally the first light source light and second light source light may emanate from different light exit windows. When sharing a light exit window, the first light source light and second light source light may emanate as mixed light from the lighting device. The light exit window(s) are thus especially radiationally coupled with the first light source and/or second light source. Hence, in embodiments the lighting device comprises a light exit window, wherein the first light source and the second light source are configured to provide said first light source light and said second light source light, respectively, downstream from said light exit window (but wherein these light sources are (thus) configured upstream from said window). The first light source and second light source may be configured to provide first light source light and second light source light in a chamber, wherein the light may be mixed, to provide mixed light downstream from the light exit window. Therefore, in embodiments the lighting device may comprise a light exit window configured to transmit at least part of said first light source light and said second light source light. In such embodiments, with the light sources being configured (e.g. in a light mixing chamber) upstream from the light exit window, the light exit window transmit at least part of the light source light of the first light source and/or the second light source, whereby the lighting device is configured to provide said first light source light and/or said second light source light downstream from the light exit window.

Light escaping from the lighting device is herein also indicated as device light. Hence, in embodiments the lighting device is configured to provide lighting device light comprising one or more of said first light source light and said second light source light. Hence, especially in these embodiments the control system is configured to control one or more of an intensity of the lighting device light and a spectral composition of said lighting device light as function of one or more of (i) an ambient light sensor signal, (ii) a motion sensor signal, (iii) a sound sensor signal, (iv) a timer signal, (v) a date signal, and (vi) a user interface signal. With respect the control system, it is further referred to above.

The lighting device may comprise a lighting unit comprising said first light source and said second light source. This lighting unit may e.g. comprise the above described light exit window. The control system may e.g. be comprised by the lighting unit or may be (at least partially) configured external from the lighting unit. Likewise, a user interface may e.g. be comprised by the lighting unit or may be (at least partially) configured external from the lighting unit (see also above). Hence, in embodiments the lighting device may further comprise a user interface, wherein the user interface comprises one or more of (a) a remote user interface and (b) a user interface integrated in a lighting unit comprising said first light source and said second light source. For instance, the lighting device may comprise such lighting unit and a remote control, e.g. a smartphone, such as an android device.

Yet, in a further aspect the invention also provides a lighting system comprising (a) the lighting device as defined herein, wherein the lighting device is configured to provide lighting device light comprising one or more of said first light source light and said second light source light, wherein the lighting system further comprises (b) a user interface functionally coupled to the control system, and (c) optionally a sensor functionally coupled to the control system, wherein the control system is configured to control one or more of an intensity of the lighting device light and a spectral composition of said lighting device light as function of one or more of (i) an ambient light sensor signal, (ii) a motion sensor signal, (iii) a sound sensor signal, (iv) a timer signal, (v) a date signal, and (vi) a user interface signal. The spectral composition especially includes one or more of said first light source light and said second light source light and optionally light source light of a further light source.

Especially, the lighting device is configured to provide said lighting device light having a Melanopsin effectiveness factor (MEF) value of at maximum 0.4, wherein MEF is defined as $$MEF = 1.22 \cdot \frac{\sum_{\lambda=380\,nm}^{\lambda=780\,nm} (SPD(\lambda) \cdot m(\lambda))}{\sum_{\lambda=380\,nm}^{\lambda=780\,nm} (SPD(\lambda) \cdot V(\lambda))}$$

wherein SPD(λ) defines the spectral power distribution of the lighting device light emitted by the lighting device, wherein m(λ) is the normalized melanopic sensitivity function (as also defined in FIG. 1), wherein V(λ)) is the normalized photopic sensitivity function (as also defined in FIG. 1).

Hence, m(λ), the normalized melanopic sensitivity function, and/or V(λ)), the normalized photopic sensitivity function, can be derived from FIG. 1.

As indicated above, the lighting device light may be controllable between different types of lighting device light having a difference in MEF of at least 0.05. For instance, in embodiments the MEF value of the lighting device light may be variable between 0.02-0.4, such as between 0.15-0.4 or between 0.02-0.2, etc. With such values, the lighting device light may have a minimum impact on the melatonin production/suppression.

In yet a further embodiment, the control unit is further configured to control the melanopsin effectiveness factor (MEF) of the white light. In this way, the white light may be tuned to the desired MEF, e.g. a high factor during the day, and a decreasing factor when approaching bed time. For instance, the first light source may be configured to provide first light source light having a variable color temperature and/or a variable MEF value. Optionally, this may also apply to the second light source.

The lighting system may thus further include a user interface. The user interface may be used to control (via the control unit) for instance one or more of the correlated color temperature, a color temperature scheme, an intensity of the white light, an input value related to the MEF, etc. The input value related to MEF may e.g. include input value like "bed time" (thus reducing MEF), "wake up" (increasing MEF), "increase alertness" (increasing MEF), "relax" (decreasing MEF), etc. etc. The user interface can be included in a remote control, such as a classical remote control, substantially only suitable for controlling the lighting apparatus. However, the user interface may also be included in a smart device, such as a mobile phone or other portable device including an app as user interface. The user interface may communicate wired or wireless, especially wireless, with the control unit. Hence, the user interface and the control unit are especially functionally connected. See further also above.

The lighting device may be part of a lighting system, wherein the lighting device may be functionally connected to one or more other devices, including one or more other lighting devices. Hence, the invention also provides a lighting system comprising one or more, especially a plurality, lighting devices. For instance, the MEF value may be chosen by the control unit as function of the day time, with e.g. a low MEF before sleeping and a high MEF to get awake, or shortly after lunch. Alternatively or additionally, the MEF value may be selected in dependence of a human activity (or inactivity). Further, the MEF value may be selected as function of location. Further, optionally or additionally, the MEF may be selected as function of a sensor, wherein the sensor is configured to sense human activity and/or human alertness.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawing is not necessarily on scale.

DETAILED DESCRIPTION OF THE EMBODIMENTS

Figure 1:
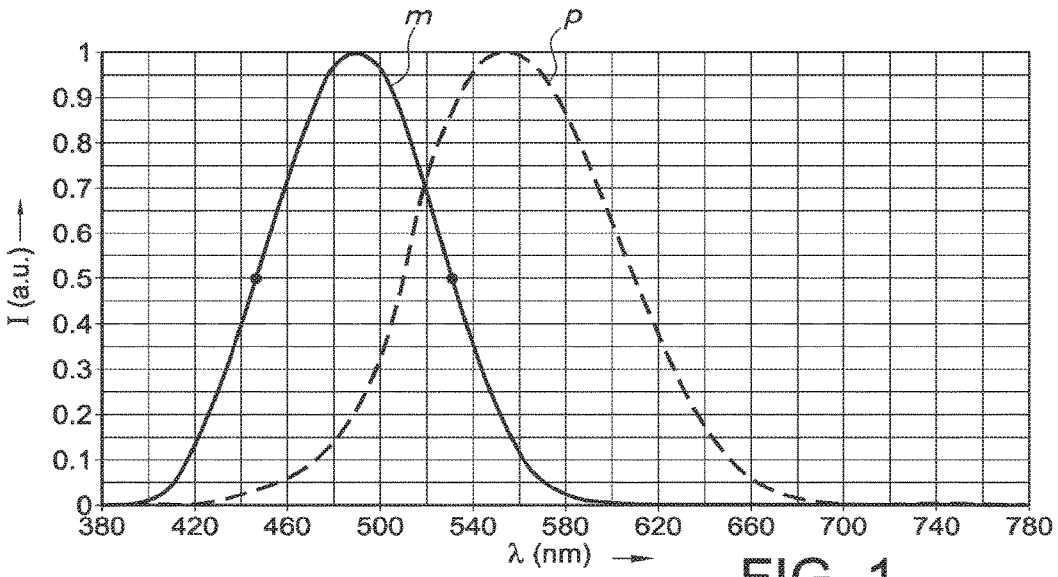
PRIOR ART FIG. 1
FIG. 1 shows the melanopic (solid line)(curve m) and photopic (dashed line)(curve p) human eye normalized sensitivity functions (see R.J. Lucas, et al., Measuring and using light in the melanopsin age, Trends in Neurosciences, Volume 37, issue 1, Jan. 2014, pp 1-9; and reference to the irradiance toolbox provided by Stuart Peirson)

FIG. 1 shows the relative melanopic (m) and photopic (p) human eye sensitivity functions. The maximum sensitivity for the melanopic function is at 490 nm, the full width half maximum values are at 447 nm and 531 nm.

Figure 2:
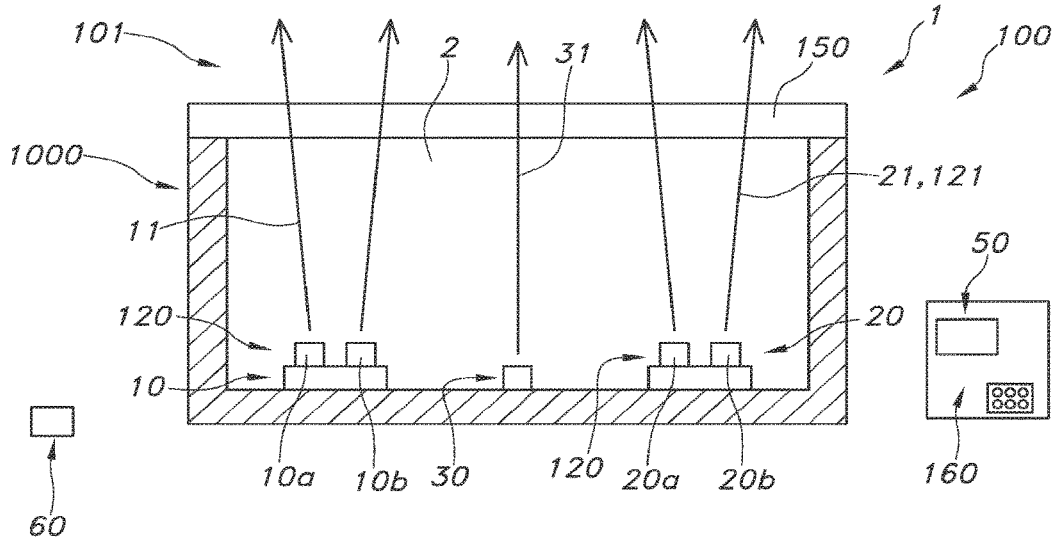
FIG. 2 schematically depicts some aspects of a lighting device, comprising a lighting unit, and a lighting system, comprising such lighting device.

FIG. 2 schematically depicts a lighting device 100 comprising a first light source 10 and a second light source 20, and a control system 50 configured to control the first light source 10 and the second light source 20. Especially, the first light source 10 and the second light source 20 are independently controllable of each other.

As indicated above, especially the first source 10 is configured to provide first light source light 11 having a correlated color temperature CCT of at maximum 3000 K, such as at maximum 2500K, and a color rendering index CRI of at least 75. The second light source 20 is configured to provide second light source light 21 having a dominant wavelength selected from the range of 575-780 nm and having a color rendering index of at maximum 70.

The lighting device comprises a lighting unit 1, which comprises said first light source 10 and said second light source 20. Further, the lighting unit 1 comprises a light exit window 150, which is transmissive for the first light source light 11 and the second light source light 21. Here, by way of example the light sources 10,20, or at least their light emissive surfaces, such as LED dies, are configured in a light mixing chamber 2. Optionally, the light sources 10,20 may be configured optically separate from each other, such as in different light mixing chambers. The light downstream from the light exit window 150 is indicated as lighting device light 101.

The terms "upstream" and "downstream" relate to an arrangement of items or features relative to the propagation of the light from a light generating means (here the especially the first or second light source), wherein relative to a first position within a beam of light from the light generating means, a second position in the beam of light closer to the light generating means is "upstream", and a third position within the beam of light further away from the light generating means is "downstream". The light exit window 150 has a transmissivity for the light source light of the light sources, thereby allowing first light source light 11 and/or second light source 21 light to propagate through the light exit window 150 and propagate further downstream from the light exit window 150, in a direction away from the lighting device 100/light unit 1.

Here, by way of example, the first light source 10 comprises a plurality of light sources 10*a*,10*b*, which provide (together) the first light source light 11, such as a blue emitting LED and a yellow emitting LED, or a white light emitting LED and a red emitting LED. However, also a single light source can be used, or a plurality of the same type of light sources can be used. Further, here by way of example, the second light source 20 comprises a plurality of light sources 20*a*,20*b*, which provide (together) the second light source light 21, such as a white light emitting LED and an amber light emitting LED. However, also a single light source can be used, or a plurality of the same type of light sources can be used, such as a plurality of amber LEDs. Further, by way of example a further light source (optional), herein also indicated as third light source, indicated with reference 30 is drawn, which is configured to provide third light source light 31. For instance, such third light source may provide white light having a color temperature above 3000 K. This may further extend the functionality of the lighting device 100. Here, by way of example the second light source 20 is configured to provide amber light 121 (as second light source light 21). The light sources 10,20 can each independently include solid state light sources, which are indicated with reference(s) 120.

Further, the lighting device 100 comprises a control system 50, especially configured to control one or more of an intensity of the lighting device light 101 and a spectral composition of said lighting device light 101 (here comprising one or more of the first light source light 11, the second light source light 21, and the third light source light 31). The control system 50 may be integrated in the lighting unit 1, but may also be (partially) configured external from the lighting unit 1. The lighting device 100 or lighting system 1000 may further comprises a user interface 160, wherein the user interface 160 may comprise one or more of a remote user interface and a user interface, for instance integrated in the lighting unit 1 comprising said first light source 10 and said second light source 20, or external thereof (as schematically depicted here).

In an embodiment, the control system 50 changes the light output automatically, depending on the input given on the user interface 160 of lighting device 100. The input can consists of (a combination of) the time of the day, date, time before sleep, ambient lighting conditions, previous light exposure or activity of the user.

In an embodiment, the control system 50 changes the light output automatically, depending on the input from connected devices. The input can consists of a combination of the time of the day, date, time before sleep, ambient lighting conditions, activity, eBook, smartphone, smartwatch, previous light exposure, audio, or video, etc.

In an embodiment, the user can select different durations for the activities. The lighting system uses this input to generate the best light setting for the user while supporting sleep.

As another example, the calculated light spectrum is not constant but changes over time, to optimally prepare for sleep.

Obviously, not all evening and nightly activities have similar lighting requirements. Some require a high color rendering while other activities do not. Use cases that are addressed with our invented luminaire are for example bedtime reading, changing diapers, going to bed, night light against fear, night time baby feeding, changing clothes, etc.

Possibly the at least two light modes not only vary in CRI but also in intensity, where the high CRI light source also produces a brighter light effect (e.g. support reading), while the low CRI light source produces dimmer light (e.g. support orientation in the room). Smooth transitions between the at least two light modes can be implemented to prevent disturbingly fast and abrupt light changes during evening and night time. At least one of the two light modes (preferably the low CRI source) is switched on/off automatically e.g. by making use of a presence sensor, while the other light mode(s) (preferably higher CRI source) can only be switched on manually by a user.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting device comprising a first light source configured to provide first light source light, a second light source configured to provide second light source light and a control system configured to control the first light source and the second light source to provide said first light source light and second light source light respectively, wherein the first light source light and the second light source light each have a melanopsin effectiveness factor (MEF) of a maximum 0.40 and wherein MEF is defined as $$MEF = 1.22 \cdot \frac{\sum_{\lambda=380\,nm}^{\lambda=780\,nm} (SPD(\lambda) \cdot m(\lambda))}{\sum_{\lambda=380\,nm}^{\lambda=780\,nm} (SPD(\lambda) \cdot V(\lambda))}$$

wherein SPD(λ) defines the spectral power distribution of the light source light emitted by the respective light source, wherein m(λ) is the normalized melanopic sensitivity function and wherein V(λ) is the normalized photopic sensitivity function, and wherein the first light source light and the second light source light have a color rendering index (CRI), the difference between the CRI of the first light source light and the CRI of the second light source light is at least 15 CRI units, and wherein at least the first light source is arranged to provide the first light source light having a maximum ratio of the total number of photons in the wavelength range of 440-530 nm to the total number of photons in the wavelength range 380-780 nm of 0.2.

2. The lighting device according to claim 1, wherein the difference between the CRI of the first light source light and the CRI of the second light source light is at least 20 CRI units.

3. The lighting device according to claim 1, wherein the CRI of the second light source light is equal to or smaller than 60 CRI units.

4. The lighting device according to claim 1, wherein said second light source is configured to provide said second light source light, having a ratio of the total number of photons in the wavelength range of 440-530 nm to the total number of photons in the wavelength range of 380-780 nm of at maximum 0.01.

5. The lighting device according to claim 1, wherein said first light source light has a MEF value $MEF_1$ and wherein said second light source light has a MEF value $MEF_2$, wherein $MEF_2 < MEF_1$.

6. The lighting device according to claim 5, wherein said first light source and said second light source are configured to provide said first light source light and said second light source light, respectively, having a difference in MEF of at least 0.05.

7. The lighting device according to claim 6, wherein said first light source is configured to provide said first light source light having said $MEF_1$ value selected from the range of 0.2-0.4, and wherein said second light source is configured to provide said second light source light having said $MEF_2$ value selected of at maximum 0.15.

8. The lighting device according to claim 1, wherein the first light source comprises one or more solid state light sources, and wherein the second light source comprises one or more solid state light sources, wherein the second light source comprises at least a solid state light source configured to provide amber light.

9. The lighting device according to claim 1, comprising a light exit window configured to transmit at least part of said first light source light and said second light source light.

10. The lighting device according to claim 1, wherein the lighting device is configured to provide lighting device light comprising one or more of said first light source light and said second light source light, wherein the control system is configured to control one or more of an intensity of the lighting device light and a spectral composition of said lighting device light as function of one or more of (i) an ambient light sensor signal, (ii) a motion sensor signal, (iii) a sound sensor signal, (iv) a timer signal, (v) a date signal, and (vi) a user interface signal.

11. The lighting device according to claim 1, further comprising a user interface wherein the user interface comprises one or more of a remote user interface and a user interface integrated in a lighting unit comprising said first light source and said second light source.

12. A lighting system comprising:

the lighting device according to claim 1, wherein the lighting device is configured to provide lighting device light comprising one or more of said first light source light and said second light source light, and a user interface functionally coupled to the control system, wherein the control system is configured to control one or more of an intensity of the lighting device light and a spectral composition of said lighting device light as function of a user interface signal.

13. The lighting system of claim 12, further comprising a timer functionally coupled to the control system, wherein the control system is configured to control one or more of an intensity of the lighting device light and a spectral composition of said lighting device light as function of a timer signal or a date signal.

14. The lighting system of claim 12, further comprising a sensor functionally coupled to the control system, wherein the control system is configured to control one or more of an intensity of the lighting device light and a spectral composition of said lighting device light as function of one or more of (i) an ambient light sensor signal, (ii) a motion sensor signal and (iii) a sound sensor signal.

15. The lighting device according to claim 1, wherein the first light source light has a correlated color temperature CCT of at maximum 3000 K and a color rendering index CRI of at least 75, and wherein the second light source light has a dominant wavelength selected from the range of 575-780 nm and a color rendering index of at maximum 70.

* * * * *